US009291385B2

(12) United States Patent
Hwang et al.

(10) Patent No.: US 9,291,385 B2
(45) Date of Patent: Mar. 22, 2016

(54) REFRIGERATOR

(71) Applicant: SAMSUNG ELECTRONICS CO., LTD., Suwon-si, Gyeonggi-do (KR)

(72) Inventors: Sung Chul Hwang, Suwon (KR); Beom Gon Kim, Suwon (KR); Yo Hyun Song, Suwon (KR); Jea Won Lee, Suwon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/250,712

(22) Filed: Apr. 11, 2014

(65) Prior Publication Data

US 2014/0306595 A1 Oct. 16, 2014

(30) Foreign Application Priority Data

Apr. 12, 2013 (KR) ..... 10-2013-0040418

(51) Int. Cl.
*F25D 23/02* (2006.01)
*E05D 7/00* (2006.01)
(Continued)

(52) U.S. Cl.
CPC ..... *F25D 23/028* (2013.01); *E05D 7/00* (2013.01); *E05D 7/0027* (2013.01); *E05F 1/1223* (2013.01); *F25D 23/00* (2013.01); *E05D 7/081* (2013.01); *E05D 2007/0461* (2013.01); *E05Y 2201/638* (2013.01); *E05Y 2900/31* (2013.01); *F25D 2323/021* (2013.01); *F25D 2323/024* (2013.01); *Y10T 16/5387* (2015.01)

(58) Field of Classification Search
CPC ..... Y10T 16/5387; Y10T 16/539; Y10T 16/5398; Y10T 16/53992; Y10T 16/54028; Y10T 16/54035; E05D 11/10; E05D 11/1007; E05D 11/1014; E05D 11/1028; E05D 11/1042; E05D 7/08; E05D 7/081; E05D 2011/1035; E05Y 2900/132; E05Y 2900/31; E05Y 2201/638; E05F 1/1223; E05F 1/063; E05F 1/1025; F25D 2323/024
USPC ..... 312/405, 326, 329, 319.2
See application file for complete search history.

(56) References Cited

U.S. PATENT DOCUMENTS 3,063,089 A * 11/1962 Greenman ..... 16/303
3,518,716 A * 7/1970 Larson ..... 16/284
(Continued)

FOREIGN PATENT DOCUMENTS

EP 2447453 * 10/2010
EP 2735828 * 5/2014
(Continued)

*Primary Examiner* — Janet M Wilkens
(74) *Attorney, Agent, or Firm* — Staas & Halsey LLP

(57) ABSTRACT

A refrigerator is equipped with an improved middle hinge module, by which a door is hinged to a main body, capable of preventing noise when the door is opened and closed and easily adjusting a height of the door. The middle hinge module includes a hinge member fixed to a main body, a casing rotatably coupled to the hinge member and configured to rotate with a door, a shaft accommodated in the casing and coupled to the hinge member, a cam member disposed on the shaft and configured to convert rotational movement of the door into vertical linear movement, a compression spring disposed on the cam member and configured to be compressed by vertical linear movement of the cam member, and a height adjustment screw, an upper portion of which is coupled to a lower portion of the shaft to adjust a height of the door.

20 Claims, 9 Drawing Sheets

(51) Int. Cl.

| | |
|---|---|
| ***F25D 23/00*** | (2006.01) |
| ***E05F 1/12*** | (2006.01) |
| *E05D 7/04* | (2006.01) |
| *E05D 7/081* | (2006.01) |

(56) References Cited

U.S. PATENT DOCUMENTS

| | | | | |
|---|---|---|---|---|
| 4,090,274 | A * | 5/1978 | Bourgeois | 16/317 |
| 4,215,449 | A * | 8/1980 | Loikitz | 16/50 |
| 4,502,183 | A * | 3/1985 | Clancy, Jr. | 16/318 |
| 4,774,740 | A * | 10/1988 | Gidseg et al. | 16/344 |
| 5,500,984 | A * | 3/1996 | Lee | 16/309 |
| 6,457,207 | B1 * | 10/2002 | Horberg | 16/50 |
| 6,935,712 | B2 * | 8/2005 | Reed et al. | 312/405 |
| 8,444,238 | B2 * | 5/2013 | Choi | 312/405 |
| 8,845,045 | B2 * | 9/2014 | Stubblefield | 312/405 |
| 2006/0143860 | A1 * | 7/2006 | Park et al. | 16/243 |
| 2007/0113379 | A1 * | 5/2007 | Lu et al. | 16/319 |
| 2011/0232036 | A1 * | 9/2011 | Dries | E05D 5/10 16/303 |
| 2011/0302743 | A1 * | 12/2011 | Kim | E05F 1/1215 16/248 |
| 2012/0030905 | A1 * | 2/2012 | Duan et al. | 16/251 |
| 2012/0206872 | A1 * | 8/2012 | Duan et al. | 361/679.01 |
| 2013/0147337 | A1 * | 6/2013 | Lim | 312/404 |
| 2013/0249371 | A1 * | 9/2013 | Lively et al. | 312/404 |
| 2013/0249472 | A1 * | 9/2013 | Hsu | 320/107 |

FOREIGN PATENT DOCUMENTS

| | | | |
|---|---|---|---|
| KR | 10-2006-0125394 | | 12/2006 |
| KR | 10-2008-0112870 | | 12/2008 |
| KR | 101054927 | * | 8/2011 |
| WO | 2008009736 | * | 1/2008 |
| WO | 2010007599 | * | 1/2010 |

* cited by examiner

REFRIGERATOR

CROSS-REFERENCE TO RELATED APPLICATIONS

This application claims the benefit of Korean Patent Application No. 10-2013-0040418, filed on Apr. 12, 2013 in the Korean Intellectual Property Office, the disclosure of which is incorporated herein by reference.

BACKGROUND

1. Field

Embodiments of the present invention relate to a refrigerator having a hinge module by which a door is hinged to a main body of the refrigerator.

2. Description of the Related Art

In general, a refrigerator is an appliance which has a storage compartment to store food therein and a cool air supply device to supply cool air to the storage compartment, to thereby keep food fresh.

A storage compartment is maintained at a temperature within a certain range to keep the food fresh.

A storage compartment has an opened front surface, which is usually closed by a door or a drawer to maintain a temperature of the storage compartment.

A door is hinged to a main body by a hinge module to open and close a storage compartment. A hinge module includes a device by which a door is automatically closed and adjusted in height.

SUMMARY

It is an aspect of the present invention to provide a refrigerator equipped with an improved hinge module, by which a door is hinged to a main body, capable of preventing noise when the door is opened and closed and easily adjusting a height of the door.

Additional aspects of the invention will be set forth in part in the description which follows and, in part, will be obvious from the description, or may be learned by practice of the invention.

In accordance with one aspect of the present invention, there is provided a refrigerator including a middle hinge module by which a door to open and close a storage compartment formed in a main body and having an opened front surface is hinged to the main body, wherein the middle hinge module includes a hinge member fixed to the main body and formed with a coupling part protruding upward such that a shaft hole having opened top and bottom portions is formed therein, a casing rotatably coupled to the coupling part to rotate with the door and formed with an accommodation part therein, a shaft inserted into the shaft hole to be fixed to the accommodation part and a lower end portion of which is inserted into the shaft hole and divided into a first part and a second part by a cutting recess, the first part protruding downward and being formed with a coupling recess having a semicircular shape at an end portion thereof, a cam member disposed on the shaft and configured to convert rotational movement of the door into vertical linear movement, a compression spring disposed on the cam member and configured to be compressed by upward linear movement of the cam member when the door is opened and transmit compressive force accumulated by downward linear movement of the cam member to the door when the door is closed, and a height adjustment screw, an upper portion of which contacts the coupling recess of the shaft so that the first part of the shaft closely contacts a wall surface of the shaft hole and the shaft is fixed to the hinge member and which is configured to move up and down by rotation to move the shaft and the casing up and down, thereby adjusting a height of the door.

The hinge member may include a fixing part fixed to the main body, and an extension part extending from the fixing part in a horizontal direction and provided with the coupling part.

The cam member may include a first cam fixed to a top portion of the shaft, and a second cam disposed on the first cam and fixed in the accommodation part so as to move linearly up and down while rotating with the casing.

The first cam may be formed with a first cam surface including plural convex portions and first flat portions at a top portion thereof, and the second cam disposed on the first cam is formed with a second cam surface including plural concave portions and second flat portions at a bottom portion thereof corresponding to the first cam surface.

When the door is in a closed state, the convex portions of the first cam surface and the concave portions of the second cam surface may be tooth-engaged with each other, and when the door is opened, the second cam may be rotated by the casing rotating with the door and may move upward by the second flat portions moving to tops of the convex portions, thereby compressing the compression spring.

When the door is closed from an opened state, the second cam may be rotated by the casing rotating with the door so that the convex portions and the concave portions are tooth-engaged, and the second cam may move downward so that compressive force of the compression spring is transmitted to the door to close the door.

The height adjustment screw may include a head part having a conical shape, a body part formed below the head part and having threads, and a recess formed at a bottom of the body part, by which the height adjustment screw is rotated.

The head part may have a flat top portion, and the top portion of the head part may have a diameter greater than a distance between the first part and the second part of the shaft so that the height adjustment screw pushes the shaft upward by moving upward by rotation.

When the shaft moves upward by the height adjustment screw, the casing to which the shaft is fixed may move upward with the shaft, thereby adjusting a height of the door.

A lower portion of the shaft hole, to which the height adjustment screw is coupled, may be formed with threads corresponding to the threads of the body part of the height adjustment screw, thereby facilitating rotation of the height adjustment screw.

In accordance with another aspect of the present invention, a refrigerator includes a main body, a storage compartment formed in the main body and having an opened front surface, side-by-side doors to open and close the storage compartment, and a middle hinge module, by which the side-by-side doors are hinged to the main body and a height of the side-by-side doors is adjusted. The middle hinge module includes a hinge member which is fixed to the main body and formed with a coupling part protruding upward such that a shaft hole having opened top and bottom portions is formed therein, a casing which is coupled to the coupling part and fixed to the side-by-side doors to move up and down with the side-by-side doors, a shaft which is inserted into the shaft hole to be fixed in the casing and configured to move up and down with the casing, and a height adjustment screw, an upper portion of which is inserted into the shaft hole to contact a lower portion of the shaft and which is configured to move up and down by rotation to move the shaft and the casing up and down.

In accordance with a further aspect of the present invention, an apparatus to attach a door to a main body of a refrigerator includes a hinge member attached to the main body and including a coupling part protruding upward such that a shaft hole having open top and bottom portions is formed therein, a casing rotatably coupled to the coupling part to rotate with the door and formed with an accommodation part therein, a shaft inserted into the shaft hole to be fixed to the accommodation part, and a lower end portion of which is inserted into the shaft hole and divided into a first part and a second part by a cutting recess, the first part protruding downward and being formed with a coupling recess having a semicircular shape at an end portion thereof, a cam member on the shaft and configured to convert rotational movement of the door into vertical linear movement, a compression spring disposed on the cam member and configured to be compressed by upward linear movement of the cam member when the door is opened and transmit compressive force accumulated by downward linear movement of the cam member to the door when the door is closed, and a height adjustment screw, an upper portion of which contacts the coupling recess of the shaft so that the first part of the shaft closely contacts a wall surface of the shaft hole and the shaft is fixed to the hinge member, and which is configured to move up and down by rotation to move the shaft and the casing up and down, thereby adjusting a height of the door.

The hinge member may include a fixing part fixed to the main body, and an extension part extending from the fixing part in a horizontal direction and provided with the coupling part.

The cam member may include a first cam fixed to a top portion of the shaft, and a second cam disposed on the first cam and fixed in the accommodation part so as to move linearly up and down while rotating with the casing.

The first cam may be formed with a first cam surface including plural convex portions and first flat portions at a top portion thereof, and the second cam disposed on the first cam is formed with a second cam surface including plural concave portions and second flat portions at a bottom portion thereof corresponding to the first cam surface.

When the door is in a closed state, the convex portions of the first cam surface and the concave portions of the second cam surface are tooth-engaged with each other, and when the door is opened, the second cam is rotated by the casing rotating with the door and moves upward by the second flat portions moving to tops of the convex portions, thereby compressing the compression spring.

When the door is closed from an opened state, the second cam is rotated by the casing rotating with the door so that the convex portions and the concave portions are tooth-engaged, and the second cam moves downward so that compressive force of the compression spring is transmitted to the door to close the door.

The height adjustment screw may a head part having a conical shape, a body part formed below the head part and having threads, and a recess formed at a bottom of the body part, by which the height adjustment screw is rotated.

The head part has a flat top portion, and the top portion of the head part has a diameter greater than a distance between the first part and the second part of the shaft so that the height adjustment screw pushes the shaft upward by moving upward by rotation.

When the shaft moves upward by the height adjustment screw, the casing to which the shaft is fixed moves upward with the shaft, thereby adjusting a height of the door.

As is apparent from the above description, by simplifying constitution of the hinge module, productivity is enhanced, noise is prevented when the door is opened and closed, and a height of the door is easily adjusted.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
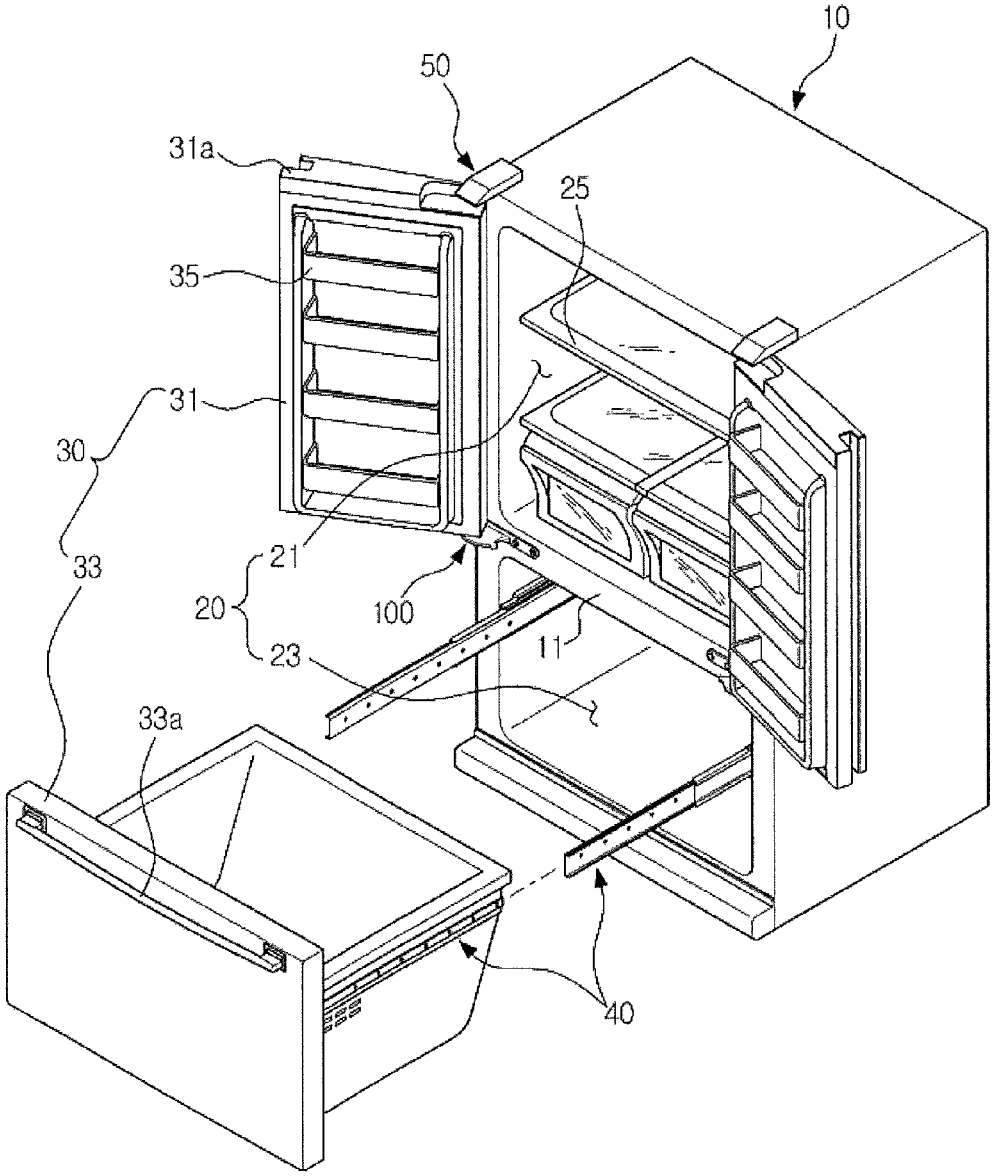
FIG. 1 is a perspective view illustrating a refrigerator according to an exemplary embodiment of the present invention.
Figure 2:
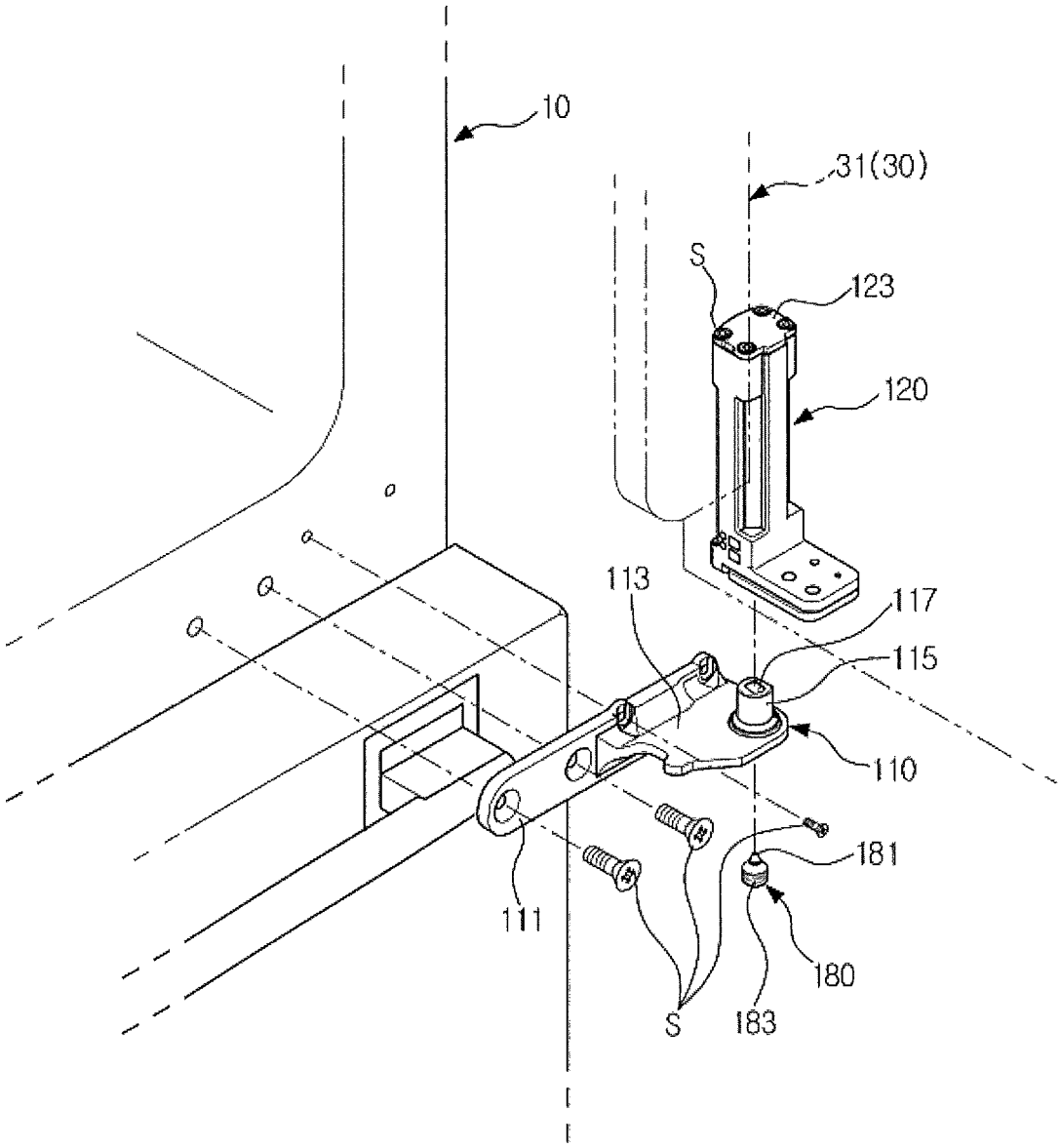
FIG. 2 is an exploded perspective view illustrating a state of coupling a middle hinge module to the refrigerator according to an exemplary embodiment of the present invention.
Figure 3:
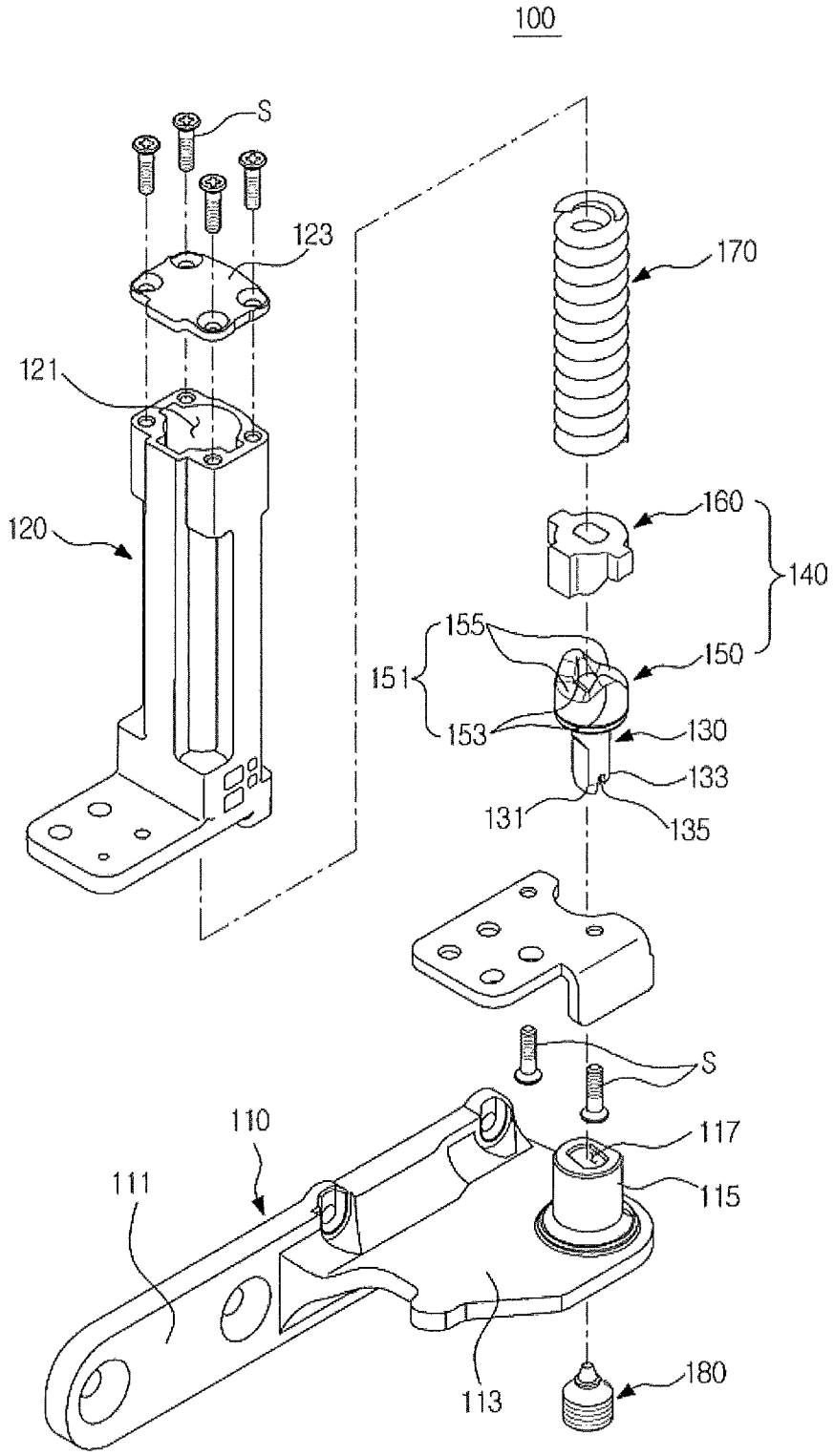
FIG. 3 is an exploded perspective view illustrating the middle hinge module according to an exemplary embodiment of the present invention.
Figure 4:
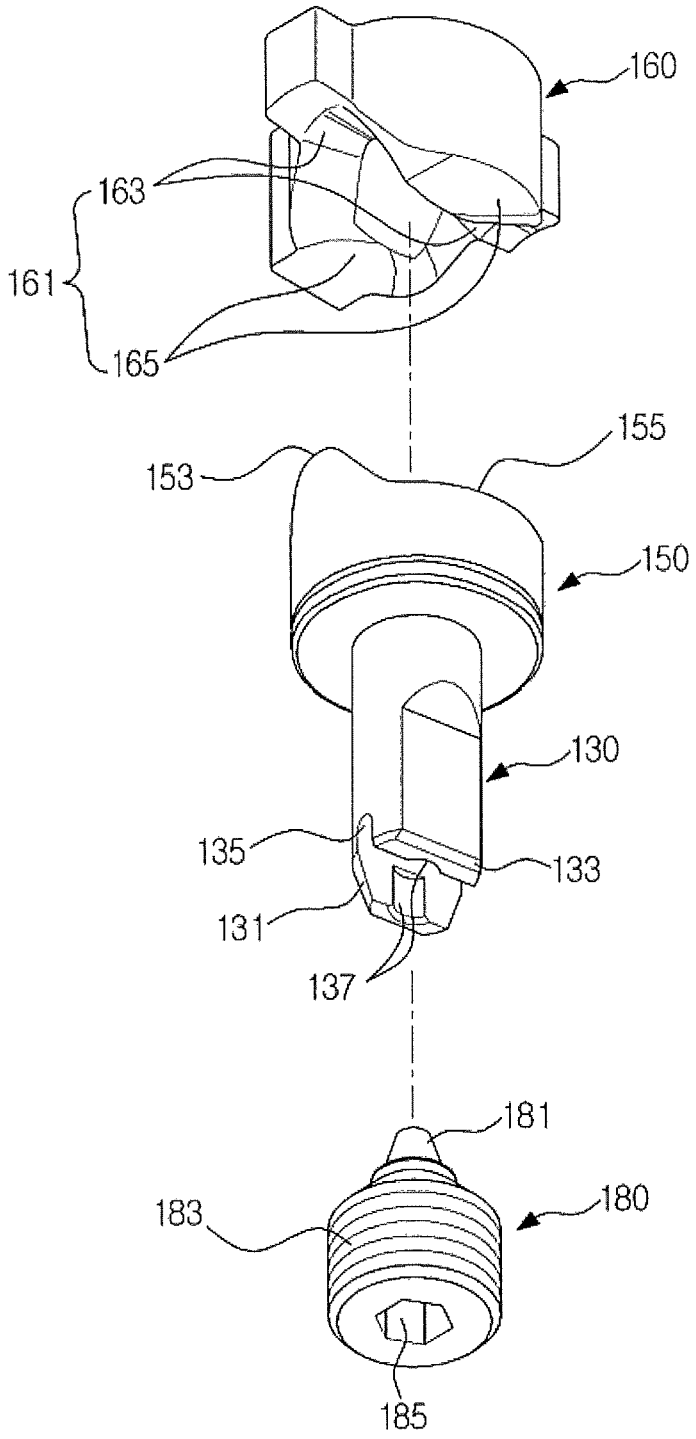
FIG. 4 is an exploded perspective view illustrating a part of the middle hinge module according to an exemplary embodiment of the present invention.

Reference will now be made in detail to the embodiments of the present invention, examples of which are illustrated in the accompanying drawings, wherein like reference numerals refer to like elements throughout.

As shown in FIG. 1, a refrigerator comprises a main body 10, storage compartments 20 formed in the main body 10 and having an opened front surface, doors 30 to open and close the storage compartments 20, a sliding device 40 by which a freezing compartment door 33 to open and close a freezing compartment 23, which is one of the storage compartments 20 and formed at a lower portion of the main body 10, is slidably coupled to the main body 10, an upper hinge module 50 which is mounted to a top portion of the main body 10 and by which a refrigerating compartment door 31 to open and close a refrigerating compartment 21, which is one of the storage compartments 20 and formed at an upper portion of the main body 10, is hinged to the main body 10, and a middle hinge module 100 which is mounted to a middle portion of the main body 10 and by which the refrigerating compartment door 31 is hinged to the main body 10.

As shown in FIG. 1, the main body 10 includes an inner casing (not shown) to define the storage compartments 20 and an outer casing (not shown) to define exterior appearance of the refrigerator. The main body further includes a cool air supply device (not shown) to supply cool air to the storage compartments 20.

The cool air supply device may include a compressor, a condenser, an expansion valve, an evaporator, a blower fan and a cool air duct. An insulator (not shown) is foamed between the inner casing and the outer casing of the main body 10 in order to prevent leakage of cool air from the storage compartments 20.

A machine room (not shown) is provided at a rear lower portion of the main body 10, in which a compressor to compress refrigerant and a condenser to condense the compressed refrigerant are mounted.

The storage compartments 20 are partitioned into an upper refrigerating compartment 21 and a lower freezing compartment 23 by a partition wall 11.

The freezing compartment 23 is opened and closed by a freezing compartment door 33 which is slidably coupled to the main body 10. A sliding device 40 is mounted to the freezing compartment door 33 and both inner side walls of the freezing compartment 23 so that the freezing compartment door 33 slides with respect to the main body 10.

The freezing compartment door 33 is provided with a knob 33*a* that a user grabs to open and close the freezing compartment door 33.

The refrigerating compartment 21 may include plural shelves 25 to be partitioned into plural spaces.

The refrigerating compartment 21 is opened and closed by a refrigerating compartment door 31 which is hinged to the main body 10. An upper hinge module 50 and a middle hinge module 100 are mounted to a top portion and a middle portion of the main body 10, respectively, so that the refrigerating compartment door 31 rotates with respect to the main body 10.

The refrigerating compartment door 31 may be implemented as side-by-side doors. A plurality of door guards 35 for food storage may be mounted to a rear surface of the refrigerating compartment door 31.

Similar to the freezing compartment door 33, the refrigerating compartment door 31 is provided with a knob 31*a* that a user grabs to open and close the refrigerating compartment door 31.

As shown in FIGS. 2 through 5, the middle hinge module 100 includes a hinge member 110 fixed to the main body 10, a casing 120 rotatably coupled to the hinge member 110 and configured to rotate with the refrigerating compartment door 31, a shaft 130 accommodated in the casing 120 and coupled to the hinge member 110, a cam member 140 disposed on the shaft 130 and configured to convert rotational movement of the refrigerating compartment door 31 into vertical linear movement, a compression spring 170 disposed on the cam member 140 and configured to be compressed by the cam member 140 moving linearly in a vertical direction, and a height adjustment screw 180, an upper portion of which is coupled to a lower portion of the shaft 130 in order to adjust the height of the refrigerating compartment door 31.

The hinge member 110 includes a fixing part 111 fixed to the main body 10, and an extension part 113 extending from the fixing part 111 in a horizontal direction.

The fixing part 111 is fixed to the main body 10 using a fastening member such as a screw S or the like. The extension part 113 extends from the fixing part 111 in a horizontal direction to support the refrigerating compartment door 31.

The extension part 113 is provided with a coupling part 115 which protrudes upward and to which the casing 120 is coupled. The coupling part 115 is formed with a shaft hole 117 therein, which has opened top and bottom portions.

The casing 120, which is coupled to the refrigerating compartment door 31 and configured to rotate with the refrigerating compartment door 31, is rotatably coupled to the coupling part 115. The shaft 130 is inserted into the shaft hole 117 formed in the coupling part 115.

A lower end portion of the shaft 130 is D-cut, for example, so that the shaft 130 is easily inserted and received in the shaft hole 117. The shaft hole 117 is formed to have a shape corresponding to the shape of the lower end portion of the shaft 130.

Since the lower end portion of the shaft 130 is D-cut and the shaft hole 117 has a shape corresponding to the shape of the lower end portion of the shaft 130, rotation of the refrigerating compartment door 31 may be easily achieved.

The casing 120 is rotatably coupled to the coupling part 115 provided at the hinge member 110, and has a peripheral surface which is coupled to the refrigerating compartment door 31 to rotate or move up and down with the refrigerating compartment door 31.

An accommodation part 121 is formed in the casing 120, and the shaft 130, the cam member 140 and the compression spring 170 are accommodated in the accommodation part 121.

A cap 123 is coupled to a top portion of the casing 120 using a fastening member such as a screw S or the like, in order to prevent separation of the cam member 140 and the compression spring 170 from the accommodation part 121.

The shaft 130 is accommodated in the accommodation part 121 and fixed to the casing 120 so as to move up and down with the casing 120. The lower end portion of the shaft 130 is inserted into the shaft hole 117 of the hinge member 110.

The lower end portion of the shaft 130 is divided into a first part 131 and a second part 133 by a cutting recess 135. The first part 131 protrudes farther downward than the second part 133.

A coupling recess 137, which has a semicircular shape, is formed at each of the lower end portions of the first part 131 and the second part 133. The height adjustment screw 180 may be easily coupled to the shaft 130 by the coupling recess 137.

Figure 9:
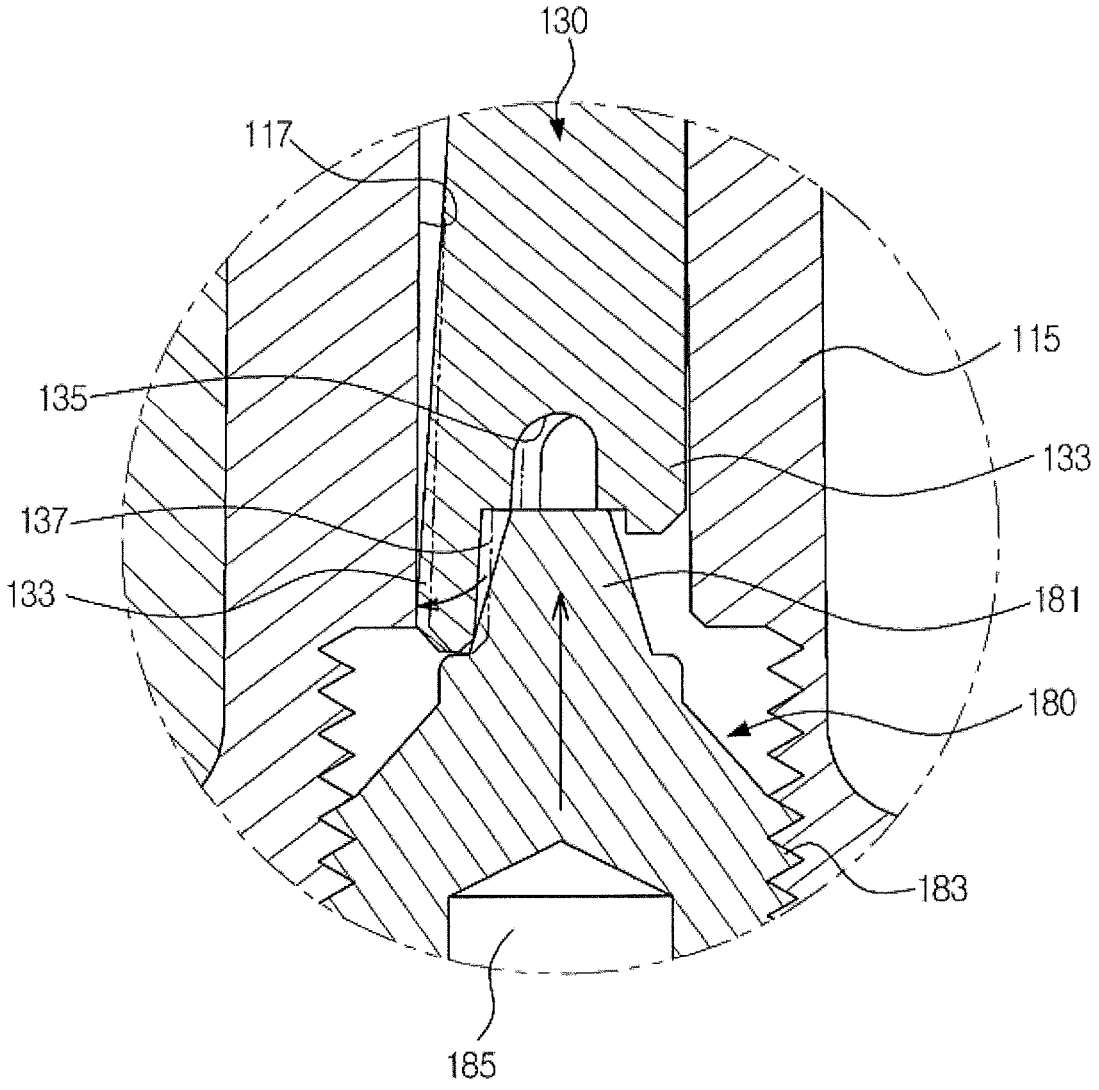
FIG. 9 is a view illustrating a state wherein a shaft is in close contact with a wall surface of a shaft hole and fixed thereto by the height adjustment screw.

As shown in FIG. 9, when the height adjustment screw 180 is coupled to the lower end portion of the shaft 130, the height adjustment screw 180 contacts the coupling recess 137 formed at the first part 131 of the shaft 130 and is rotated to move upward. Accordingly, the height adjustment screw 180 pushes the first part 131 of the shaft 130 to a wall surface of the shaft hole 117, so that the shaft 130 is fixed to the hinge member 110.

When the opened refrigerating compartment door 31 is closed, the shaft 130 is automatically returned by the cam member 140 and the compression spring 170. At this time, rattling noise may be generated between the shaft 130 and the shaft hole 117 into which the shaft 130 is inserted because of a tolerance between the shaft 130 and the shaft hole 117. According to this embodiment, since the shaft 130 is in close contact with the shaft hole 117 and securely fixed to the shaft hole 117 without rattling by the height adjustment screw 180, rattling noise between the shaft 130 and the shaft hole 117 is reduced.

The cam member 140 is disposed on the shaft 130 and configured to convert rotational movement of the refrigerating compartment door 31 into vertical linear movement. The cam member 140 includes a first cam 150 fixed to a top portion of the shaft 130 and a second cam 160 disposed on the first cam 150 and configured to rotate with the casing 120.

The first cam 150 is fixed to the top portion of the shaft 130. The first cam 150 is formed with a first cam surface 151 at a top portion thereof, which includes plural convex portions 153 protruding upward and plural first flat portions 155 formed flat between the plural convex portions 153.

The second cam 160 is disposed on the first cam 150. The second cam 160 is fixed in the accommodation part 121 formed in the casing 120, so as to move up and down while rotating with the casing 120.

The second cam 160 is formed with a second cam surface 161 at a bottom portion thereof, which has a shape corresponding to the first cam surface 151. The second cam surface 161 includes plural concave portions 163 corresponding to the convex portions 153 of the first cam surface 151 and plural second flat portions 165 corresponding to the first flat portions 155.

Figure 5:
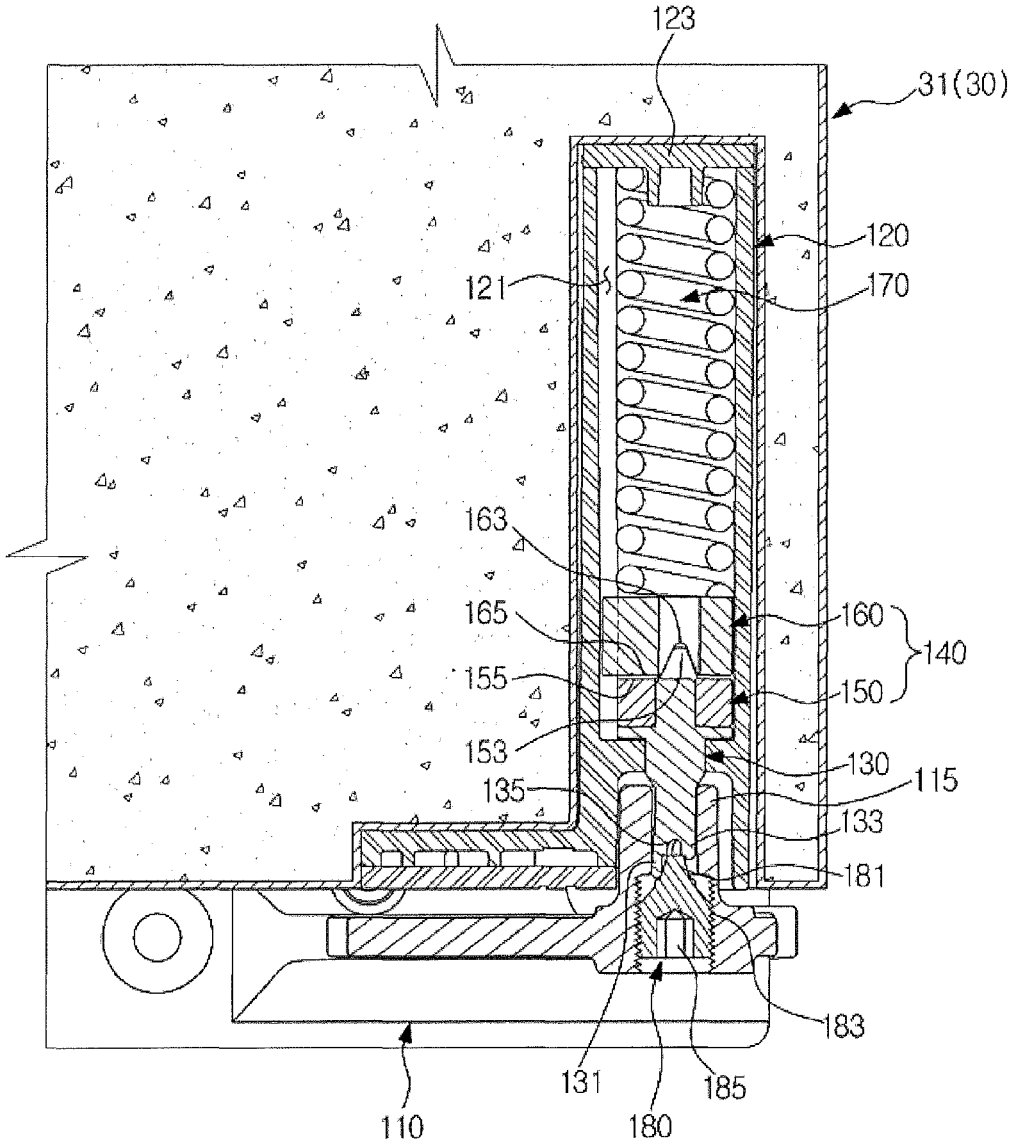
FIG. 5 is a sectional view illustrating the middle hinge module coupled to the refrigerator according to an exemplary embodiment of the present invention.

When the refrigerating compartment door 31 is in a closed state, as shown in FIG. 5, the first cam 150 and the second cam 160 are in contact with each other in such a manner that the plural convex portions 153 of the first cam surface 151 of the first cam 150 are tooth-engaged with the plural concave portions 163 of the second cam surface 161 of the second cam 160.

Since the convex portions 153 and the concave portions 163 are tooth-engaged with each other, the first flat portions 155 of the first cam surface 151 and the second flat portions 165 of the second cam surface 161 are also tooth-engaged with each other.

Figure 6:
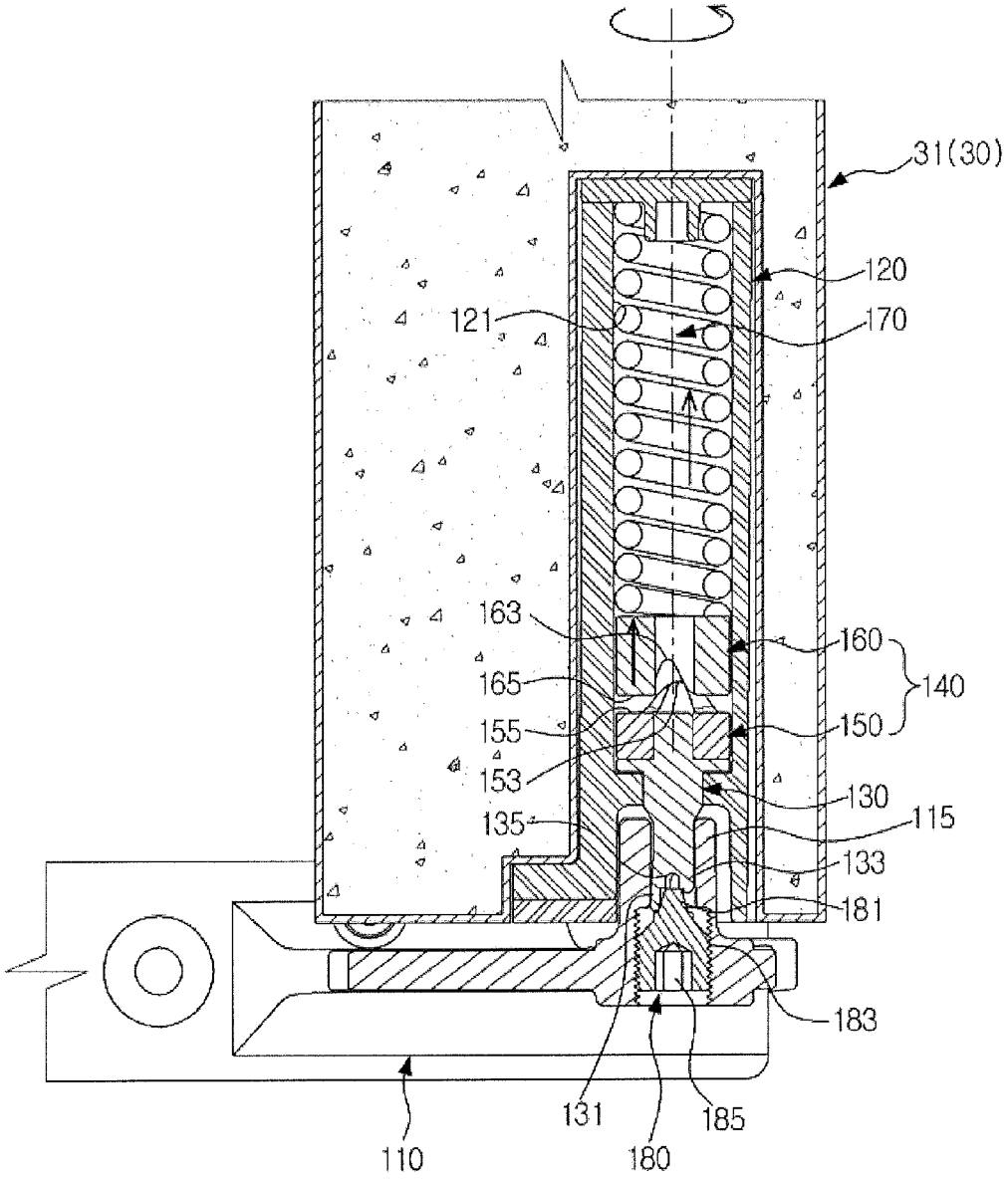
FIGS. 6 and 7 are views illustrating a process of opening and closing a refrigerating compartment door of the refrigerator according to an exemplary embodiment of the present invention.

When the refrigerating compartment door 31 rotates to be opened, as shown in FIG. 6, the casing 120 rotates with the refrigerating compartment door 31, and the second cam 160 fixed to the accommodation part 121 formed in the casing 120 also rotates with the casing 120.

The second cam 160 rotates on the first cam 150, and the second flat portions 165 of the second cam surface 161 move to the tops of the convex portions 153 of the first cam surface 151 along the surfaces of the convex portions 153.

By movement of the second flat portions 165 to the tops of the convex portions 153, the second cam 160 moves upward, and the compression spring 170 is compressed by the second cam 160.

Figure 7:
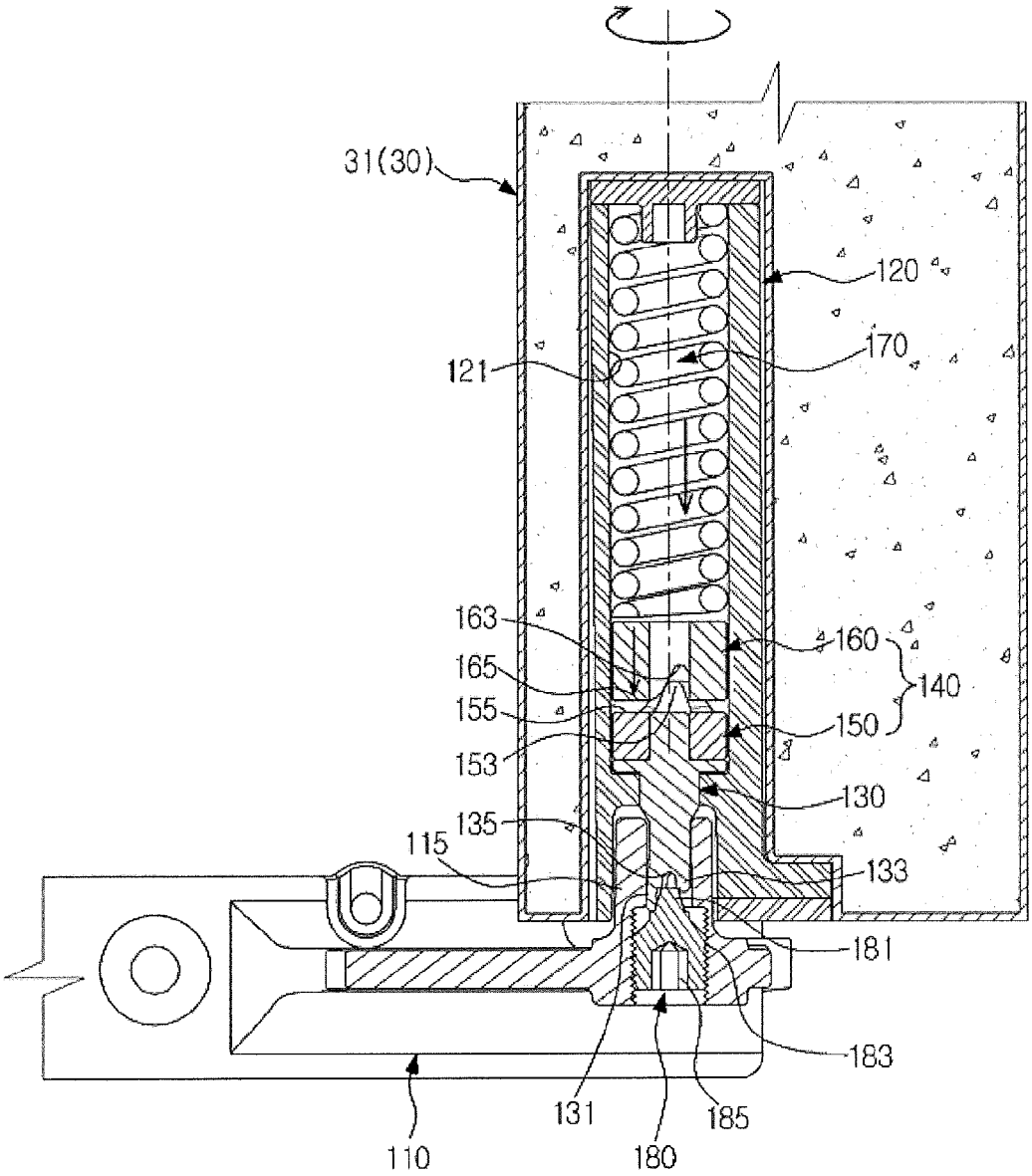

When the refrigerating compartment door 31 is in an opened state, the compression spring 170 is compressed by upward movement of the second cam 160 and thus accumulates compressive force. As shown in FIG. 7, when the refrigerating compartment door 31 is closed, the refrigerating compartment door 31 rotates, and the casing 120 and the second cam 160 rotate with the refrigerating compartment door 31. Accordingly, the second flat portions 165 of the second cam surface 161 move along the surfaces of the convex portions 153 of the first cam surface 151.

When the refrigerating compartment door 31 rotates by a predetermined angle, the second flat portions 165 of the second cam surface 161 move along the surfaces of the convex portions 153 of the first cam surface 151, and the concave portions 163 of the second cam surface 161 are tooth-engaged with the convex portions 153 of the first cam surface 151. Accordingly, the second cam 160 moves downward, and the refrigerating compartment door 31 is automatically closed by the compressive force accumulated in the compression spring 170.

Figure 8:
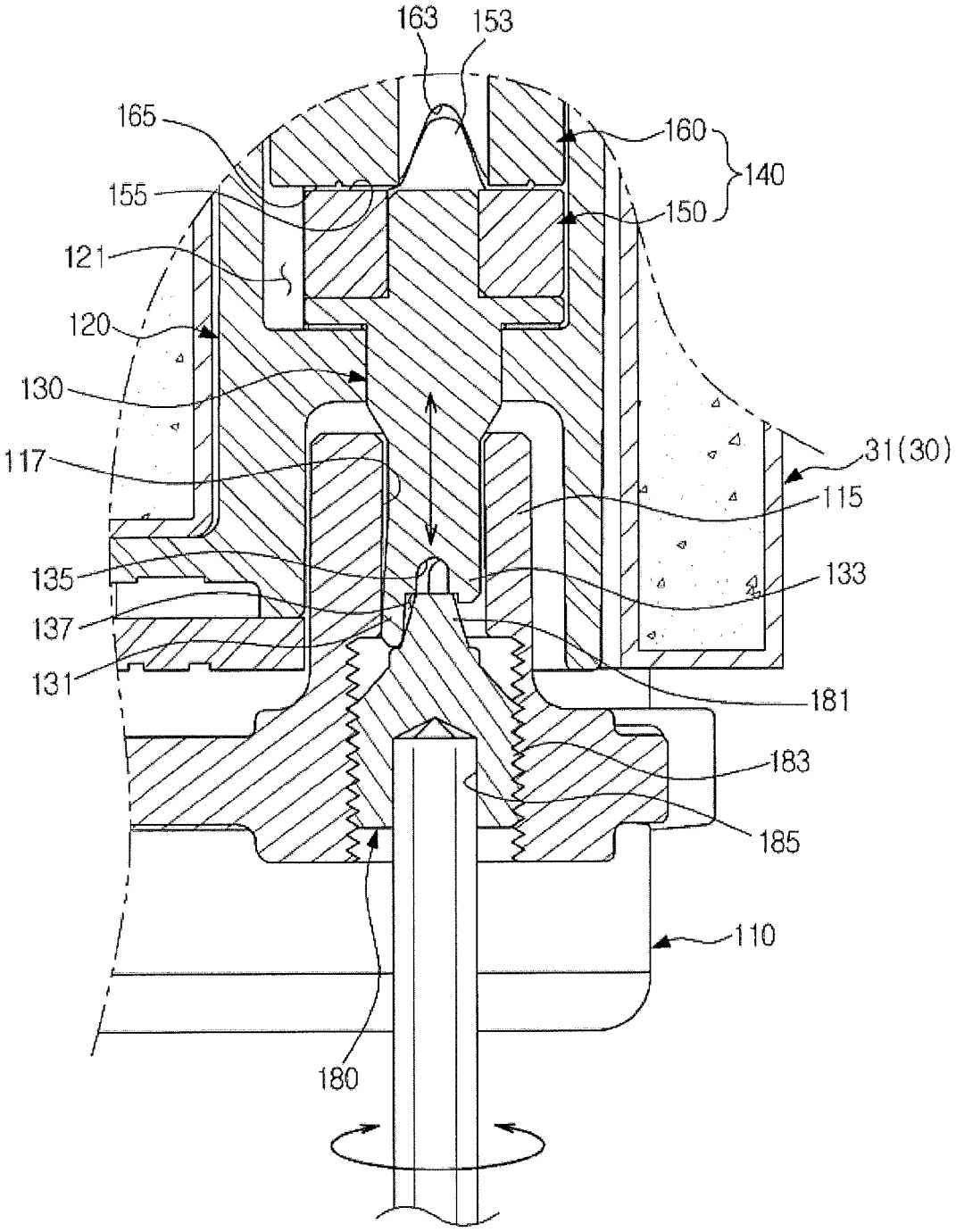
FIG. 8 is a view illustrating a process of adjusting a height of the refrigerating compartment door using a height adjustment screw.

As shown in FIGS. 5, 8 and 9, the compression spring 170 is accommodated in the accommodation part 121 of the casing 120 and disposed on the second cam 160.

The compression spring 170 is compressed when the second cam 160 moves upward and accumulates compressive force. When the second cam 160 moves downward, the compressive force accumulated in the compression spring 170 is transmitted to the refrigerating compartment door 31 so that the refrigerating compartment door 31 is automatically closed.

The height adjustment screw 180 includes a head part 181 which has a conical shape and is formed at an upper portion thereof, a body part 183 which is formed below the head part 181 and has threads, and a recess 185 which is formed at a bottom of the body part 183 and by which the height adjustment screw 180 is rotated.

The head part 181 has a flat top portion, and contacts the lower end portion of the shaft 130 to push the first part 131 of the shaft 130 to the wall surface of the shaft hole 117, so that the shaft 130 is securely fixed to the hinge member 110.

The top portion of the head part 181 has a diameter greater than a distance between the first part 131 and the second part 133 of the shaft 130 so that the height adjustment screw 180 pushes the shaft 130 upward by moving upward by rotation.

The height adjustment screw 180 is formed with threads on an outer circumferential surface of the body part 183. A lower portion of the shaft hole 117, to which the height adjustment screw 180 is coupled, is formed with threads corresponding to the threads of the body part 183 of the height adjustment screw 180. Accordingly, the height adjustment screw 180 is easily rotated inside the shaft hole 117.

The recess 185 formed at the bottom of the body part 183 allows a user to easily rotate the height adjustment screw 180 using tools such as screwdrivers, wrenches or the like.

When the height adjustment screw 180 is rotated, the height adjustment screw 180 moves up and down according to a rotational direction, and the shaft 130 also moves up and down with the height adjustment screw 180. Because the shaft 130 is fixed to the casing 120, the casing 120 moves up and down with the shaft 130 and accordingly, the height of the refrigerating compartment door 31 is adjusted.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a hinge module by which a door to open and close a storage compartment formed in a main body and having an opened front surface is hinged to the main body, wherein the hinge module comprises:

a hinge member fixed to the main body and formed with a coupling part protruding upward such that a shaft hole having an opened top formed therein;

a casing rotatably coupled to the coupling part to rotate with the door and formed with an accommodation part therein;

a shaft inserted into the shaft hole to be fixed to the accommodation part, and a lower end portion of which is inserted into the shaft hole and divided into a first part and a second part, the first part protruding downward and being formed with a coupling recess;

a cam member disposed on the shaft and configured to convert rotational movement of the door into vertical linear movement;

a spring disposed on the cam member and configured to be compressed by upward linear movement of the cam member when the door is opened and transmit compressive force by downward linear movement of the cam member to the door when the door is closed; and a contacting member included in the hinge member, an upper portion of which contacts the coupling recess of the shaft so that the first part of the shaft closely contacts a wall surface of the shaft hole.

2. The refrigerator according to claim 1, wherein the hinge member includes a fixing part fixed to the main body, and an extension part extending from the fixing part in a horizontal direction and provided with the coupling part.

3. The refrigerator according to claim 1, wherein the cam member includes a first cam fixed to a top portion of the shaft, and a second cam disposed on the first cam and fixed in the accommodation part so as to move linearly up and down while rotating with the casing.

4. The refrigerator according to claim 3, wherein the first cam is formed with a first cam surface including plural convex portions and first flat portions at a top portion thereof, and the second cam disposed on the first cam is formed with a second cam surface including plural concave portions and second flat portions at a bottom portion thereof corresponding to the first cam surface.

5. The refrigerator according to claim 4, wherein when the door is in a closed state, the convex portions of the first cam surface and the concave portions of the second cam surface are tooth-engaged with each other, and when the door is opened, the second cam is rotated by the casing rotating with the door and moves upward by the second flat portions moving to tops of the convex portions, thereby compressing the spring.

6. The refrigerator according to claim 5, wherein when the door is closed from an opened state, the second cam is rotated by the casing rotating with the door so that the convex portions and the concave portions are tooth-engaged, and the second cam moves downward so that compressive force of the spring is transmitted to the door to close the door.

7. The refrigerator according to claim 1, wherein the contacting member includes a height adjustment screw which is configured to move up and down by rotation to move the shaft and the casing up and down, thereby adjusting a height of the door, wherein the height adjustment screw includes a head part having a conical shape, a body part formed below the head part and having threads, and a recess formed at a bottom of the body part, by which the height adjustment screw is rotated.

8. The refrigerator according to claim 7, wherein the head part has a flat top portion, and the top portion of the head part has a diameter greater than a distance between the first part and the second part of the shaft so that the height adjustment screw pushes the shaft upward by moving upward by rotation.

9. The refrigerator according to claim 8, wherein when the shaft moves upward by the height adjustment screw, the casing to which the shaft is fixed moves upward with the shaft, thereby adjusting a height of the door.

10. The refrigerator according to claim 7, wherein a lower portion of the shaft hole, to which the height adjustment screw is coupled, is formed with threads corresponding to the threads of the body part of the height adjustment screw, thereby facilitating rotation of the height adjustment screw.

11. A refrigerator comprising:

a main body;

a storage compartment formed in the main body and having an opened front surface;

side-by-side doors to open and close the storage compartment; and a hinge module, by which a first door among the side-by-side doors is hinged to the main body and a height of the first door is adjusted, wherein the hinge module includes:

a hinge member fixed to the main body and formed with a coupling part protruding upward such that a shaft hole having an opened top formed therein;

a casing coupled to the coupling part and fixed to the first door to move up and down with the first door;

a shaft inserted into the shaft hole to be fixed in the casing and configured to move up and down with the casing, and a lower end portion of which is inserted into the shaft hole and divided into a first part and a second part by a cutting recess;

a cam member disposed on the shaft and configured to convert rotational movement of the first door into vertical linear movement;

a spring disposed on the cam member and configured to be compressed when the cam member moves upward, and to transmit a compressive force to the first door when the cam member moves downward; and a height adjustment member, an upper portion of which is inserted into the shaft hole to contact the first part of the shaft so that the first part of the shaft closely contacts a wall surface of the shaft hole, and which is configured to adjust by rotation to move the shaft and the casing up and down.

12. An apparatus configured to attach a door to a main body of a refrigerator, the apparatus comprising:

a hinge member configured to be attachable to the main body and including a coupling part protruding upward such that a shaft hole having an open top formed therein;

a casing rotatably coupled to the coupling part and formed with an accommodation part therein, the casing being configured to be coupled with the door and to be moveable with rotation of the door;

a shaft inserted into the shaft hole to be fixed to the accommodation part, and a lower end portion of which is inserted into the shaft hole and divided into a first part and a second part by a cutting recess, the first part protruding downward and being formed with a coupling recess;

a cam member disposed on the shaft and configured to convert rotational movement of the door into vertical linear movement, when the casing is coupled with the door and the door is rotated;

a spring disposed on the cam member and configured to be compressed by upward linear movement of the cam member when the casing is coupled with the door and the door is opened, and to transmit compressive force by downward linear movement of the cam member to the door when the casing is coupled with the door and the door is closed; and a height adjustment member, an upper portion of which contacts the coupling recess of the shaft so that the first part of the shaft closely contacts a wall surface of the shaft hole and the shaft is fixed to the hinge member, and which is configured to move up and down by rotation to move the shaft and the casing up and down, and configured to adjust a height of the door when the casing is coupled with the door.

13. The apparatus according to claim 12, wherein the hinge member includes a fixing part which is configured to be fixed to the main body, and an extension part extending from the fixing part in a horizontal direction and provided with the coupling part.

14. The apparatus according to claim 12, wherein the cam member includes a first cam fixed to a top portion of the shaft, and a second cam disposed on the first cam and fixed in the accommodation part so as to move linearly up and down while rotating with the casing.

15. The apparatus according to claim 14, wherein the first cam is formed with a first cam surface including plural convex portions and first flat portions at a top portion thereof, and the second cam disposed on the first cam is formed with a second cam surface including plural concave portions and second flat portions at a bottom portion thereof corresponding to the first cam surface.

16. The apparatus according to claim 15, wherein the convex portions of the first cam surface and the concave portions of the second cam surface are configured to be tooth-engaged with each other when the casing is coupled with the door and the door is in a closed state, and the second cam is configured to be rotated by the casing rotating with the door and moves upward by the second flat portions moving to tops of the convex portions, thereby compressing the spring, when the casing is coupled with the door and the door is opened.

17. The apparatus according to claim 16, wherein the second cam is configured to be rotated by the casing rotating with the door so that the convex portions and the concave portions are tooth-engaged, and the second cam moves downward so that compressive force of the spring is transmitted to the door to close the door, when the casing is coupled with the door and the door is closed from an opened state.

18. The apparatus according to claim 12, wherein the height adjustment member includes a head part having a conical shape, a body part formed below the head part and having threads, and a recess formed at a bottom of the body part, by which the height adjustment member is rotated.

19. The apparatus according to claim 18, wherein the head part has a flat top portion, and the top portion of the head part has a diameter greater than a distance between the first part and the second part of the shaft so that the height adjustment member pushes the shaft upward by moving upward by rotation.

20. The apparatus according to claim 19, wherein when the shaft moves upward by the height adjustment member, the casing to which the shaft is fixed moves upward with the shaft, thereby adjusting a height of the door, when the casing is coupled with the door.

* * * * *